United States Patent [19]

Russell

[11] 3,943,025

[45] Mar. 9, 1976

[54] LAMINATING TRAVELLING PRESS

[76] Inventor: George F. Russell, 8513 42nd W., Tacoma, Wash. 98466

[22] Filed: May 7, 1973

[21] Appl. No.: 357,960

[52] U.S. Cl. ..... 156/380; 156/555; 156/580; 144/281 B

[51] Int. Cl.[2] ..... B27D 3/04; B30B 5/06

[58] Field of Search ..... 156/380, 580, 555, 273; 100/151; 144/281 C, 281 B; 219/10.81

[56] References Cited

UNITED STATES PATENTS

| | | | |
|---|---|---|---|
| 2,597,923 | 5/1952 | Croston | 156/380 |
| 3,191,522 | 6/1965 | Drake et al. | 156/380 |
| 3,691,942 | 9/1972 | Wagley | 100/151 |
| 3,723,230 | 3/1973 | Troutner | 156/580 |

*Primary Examiner*—Douglas J. Drummond
*Assistant Examiner*—M. G. Wityshyn
*Attorney, Agent, or Firm*—Robert W. Beach

[57] ABSTRACT

Tread plates on mutually opposed endless belts clamp and move a pack of boards horizontally lengthwise between electrodes for setting adhesive between the boards by dielectric heating. The tread plates are engaged by backing members spaced transversely of the length of the belt, and the tread plates are connected by a chain located between the backing members. The portions of the tread plates engageable with a surface of the board pack are of a suitable plastic to deter passage of radio-frequency energy from an electrode to an electrically-grounded portion of a tread plate or to the chain. Air bags are inflatable to press at least one endless belt against the board pack or to move such belt relative to supporting means away from the board pack. Adjusting means for prepressing rollers ahead of the endless tread belts on one side of the board pack and adjusting means for the endless tread belt on the same side of the board pack are interconnected for synchronized adjustment. A plurality of pivoted pressure rollers spaced lengthwise of the path of movement of the board pack ahead of the endless belts for engaging the board edges are connected by chains to synchronize them for conjoint movement toward and away from the sides of the board pack. Such rollers can be profiled to hold the boards of the pack in relatively offset relationship if desired. Also, the endless belts can be curved to bend the pack of boards lengthwise.

6 Claims, 12 Drawing Figures

LAMINATING TRAVELLING PRESS

The present invention relates to laminating travelling presses of the endless tread type which are particularly useful for laminating packs of boards in the manufacture of laminated beams or posts.

A principal object of the invention is to provide a laminating travelling press for setting adhesive by dielectric heating utilizing endless tread belts constructed to grip securely a pack of boards to be laminated and to minimize leakage of radio-frequency energy from the electrodes to grounded portions of the endless tread belts.

Another object is to provide mechanism for synchronizing adjustment of different presser mechanisms of the press so that such presser mechanisms will be located simultaneously at approximately the same elevations.

It is also an object to provide powered upper and lower moving means engageable with a pack of boards which are driven in synchronism so that the boards of the pack will be retained in proper registration.

An additional object is to provide presser mechanism which can exert substantial pressure on a pack of boards to be laminated without such pressure being transmitted through drive mechanism for moving the presser means engaged with the pack of boards.

Figure 1:
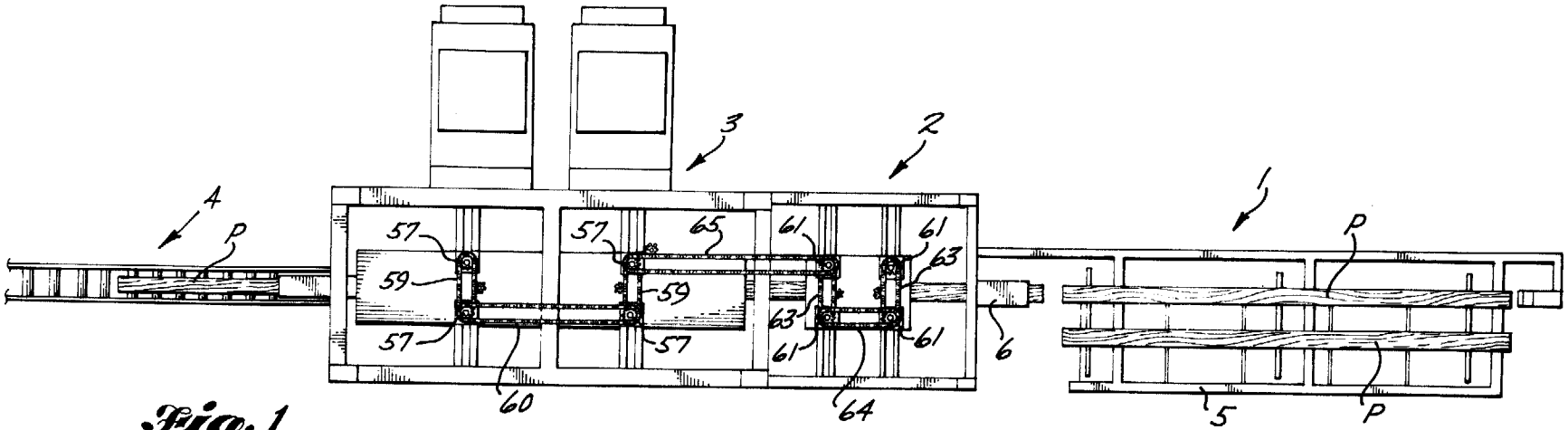
FIG. 1 is a plan of a laminating travelling press according to the present invention.
Figure 2:
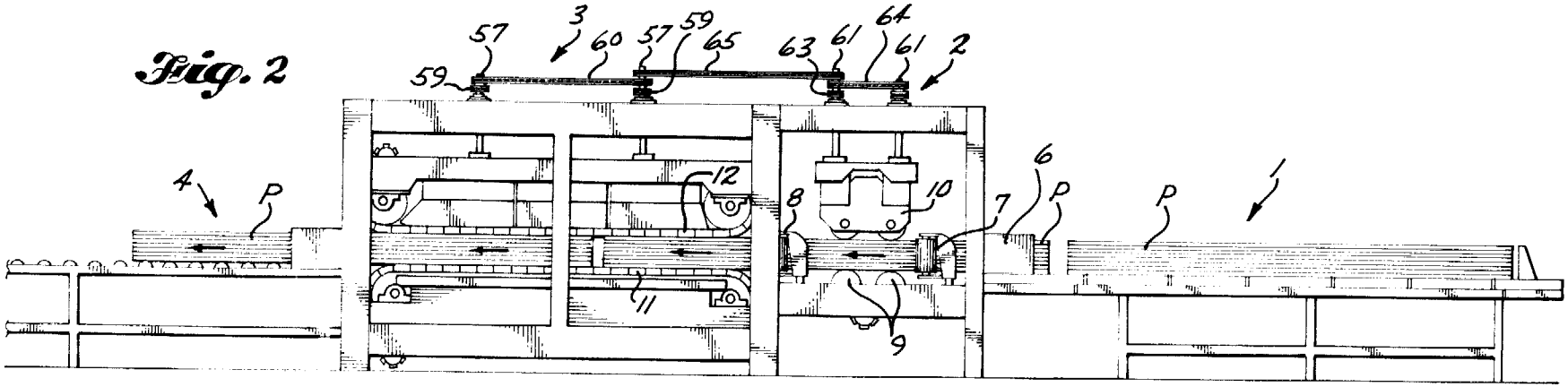
FIG. 2 is a side elevation of such press.

The laminating travelling press shown generally in FIGS. 1 and 2 includes in sequence an infeed section 1, a prepress section 2, a main press section 3 and an outfeed section 4. Packs P of boards to be laminated are supplied in stacked condition with adhesive between them to the table 5 of the infeed section. Such adhesive is preferably a thermosetting resin which can be set by dielectric heating or chemical action. The table 5 may accommodate several packs in side-by-side relationship, which can be moved transversely of their lengths successively into alignment with the other sections of the press.

From the infeed section 1, the packs P are fed lengthwise through the tunnel 6 into the prepress section 2. Each such pack is fed between at least two sets of upright side evening rollers 7 and 8 spaced lengthwise of the path of movement of the pack of boards through the press. The evening rollers of each pair are pressed toward each other so as to move the boards of each pack relatively edgewise into precise registration before the adhesive between adjacent boards is set.

In the prepress section 2, the pack of boards is supported by a plurality of live rollers 9 and is compacted by hold-down mechanism 10. With the boards in the pack evened edgewise and with the pack of boards thus preliminarily compacted, the pack is fed by the prepress section into the press section 3 between a lower endless tread belt 11 and an upper endless tread belt 12. These belts move the pack through the main press section where the adhesive is set, after which the endless tread belts discharge the pack to the outfeed section 4.

Figure 3:
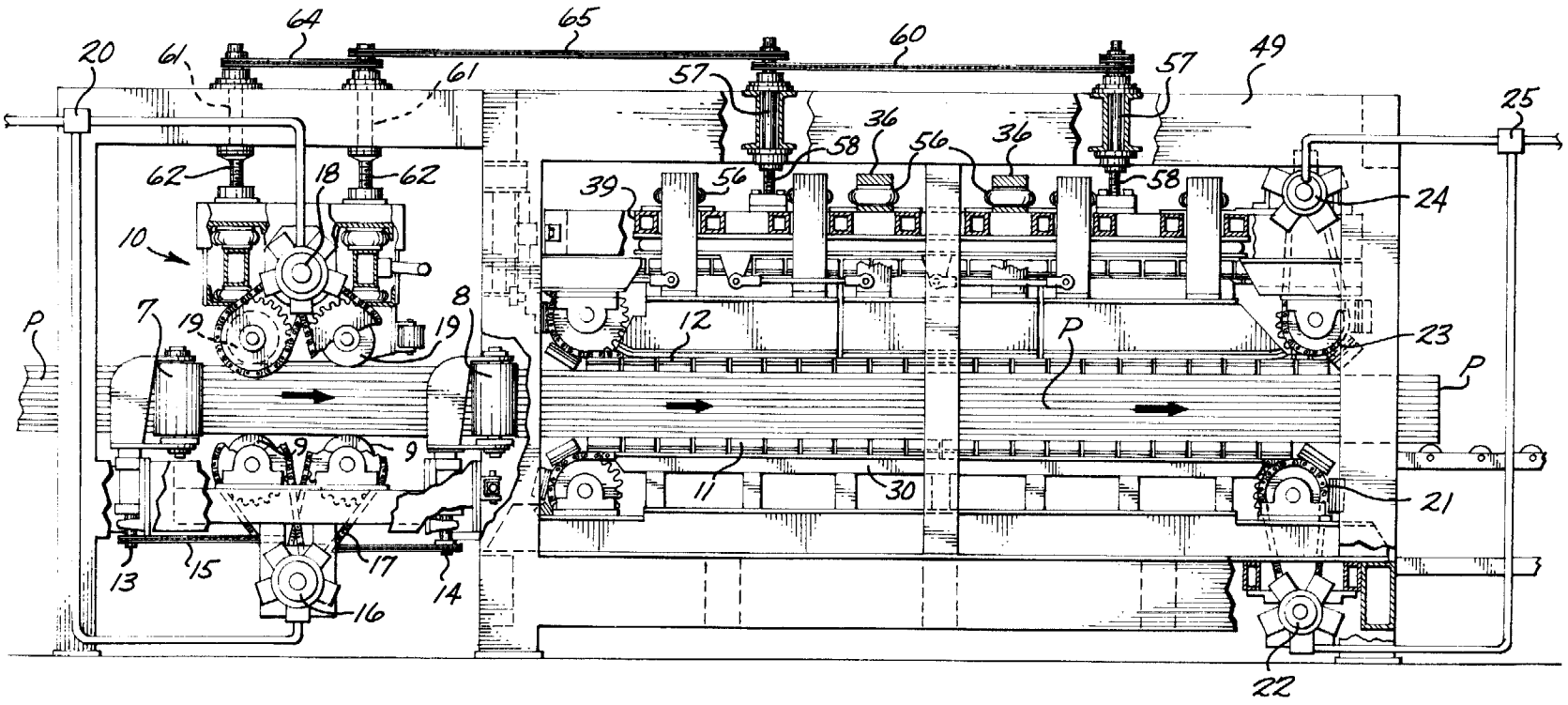
FIG. 3 is an enlarged side elevation of the press side opposide the side shown in FIG. 2, parts being broken away.

As shown in FIG. 3, each infeed side evening roller 7 is mounted eccentrically on a swivel shaft 13, and each outfeed side evening roller 8 is mounted eccentrically on a swivel shaft 14. Sprockets on the two swivel shafts 13 and 14 on the same side of a board pack are connected by a chain 15, so as to synchronize swivelling of the rollers 7 and 8. As a pack of boards enters between the infeed evening rollers 7, therefore, and they are spread to receive such pack, the outfeed rollers 8 will be spread correspondingly by the chain 15 turning shaft 14 to the same degree that shaft 13 is turned by swivelling of rollers 7. Consequently, rollers 8 will be spread to the same extent as rollers 7.

The side evening rollers 7 and 8 may be idler rollers or may be live rollers. The rollers 9 supporting the pack of boards in the feed press section are live rollers, preferably being driven by a hydraulic motor 16 connected by chain and sprocket drives 17 to the live rollers 9. Correspondingly, a hydraulic motor 18 drives live rollers 19 of the hold-down 10, which bear on the upper side of the board pack in the prepress section. In order to obtain the most effective driving action of the lower rollers 9 and the upper rollers 19, it is preferred that each upper roller 19 be disposed substantially directly above a lower roller 9, as shown in FIG. 3.

In moving the packs of boards P through the prepress section 2, it is important that the same tractive effort be applied to the top and bottom of the pack so as to avoid any tendency of boards in the pack to be slipped lengthwise relative to each other. Consequently, the lower live rollers 9 and the upper live rollers 19 are driven at precisely the same speed by effecting rotation of the hydraulic motors 16 and 18 driving the lower and upper live rollers, respectively, in exact synchronism. Synchronization of these motors is effected by supplying liquid under pressure to them by the flow-divider 20 which regulates the flow of driving liquid to the two motors equally.

As the packs P of boards are fed by the prepress section 2 into the main press section 3, the board packs are conveyed by cooperation of the lower and upper endless tread belts 11 and 12. The lower belt 11 is moved by chain 21 driven by a hydraulic motor 22. The upper endless tread belt 12 is moved by a chain 23 driven by a hydraulic motor 24. Again, it is important for the lower endless tread belt and the upper endless tread belt to be driven in precise synchronism. Consequently, liquid is supplied both to the lower motor 22 and to the upper motor 24 through a flow-divider 25 which proportions the flow of liquid to the two motors exactly equally.

Figure 4:
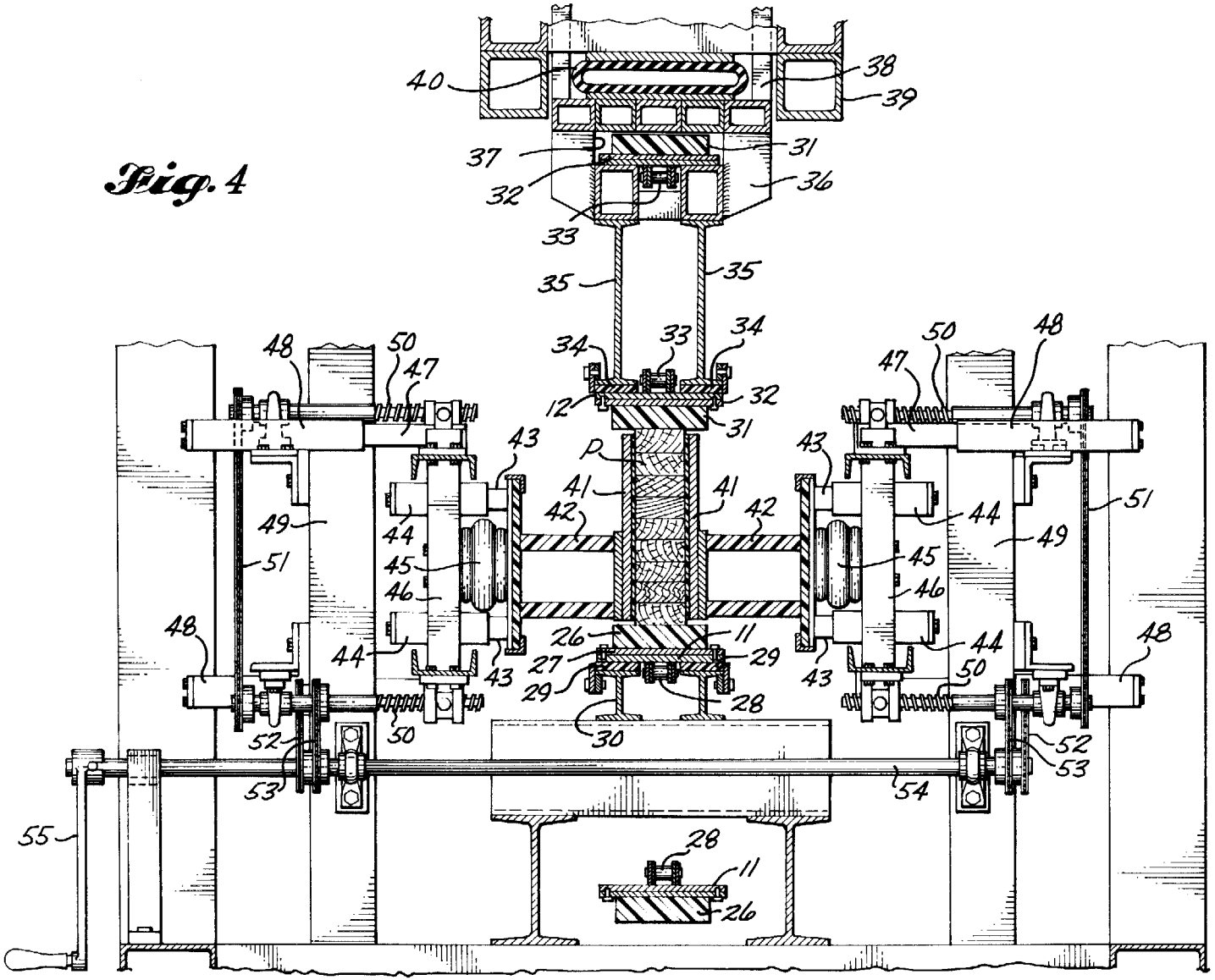
FIG. 4 is a transverse section through the press on a further enlarged scale taken on line 4—4 of FIG. 5.

The constructions of the lower endless tread belt 11 and of the upper endless tread belt 12 are substantially the same, as indicated in FIG. 4, and provide substantially continuous planar parallel opposing press faces. The tread plates 26 of the lower belt 11 are made of quite hard dielectric material, such as polyurethane having a durometer value of 90. Such plastic mounting components are bonded to tread plates 27 that are secured by bolts to the plate elements 11 secured to the endless chain 28 driven by the drive chain 21. The tread components are mounted in closely spaced relationship as shown in FIG. 3 to provide the substantially continuous pressure face engageable with the board pack.

The endless chain 28 does not carry any weight of the tread plates 26, 27 or of the pack P of boards supported by such tread plates. Instead, opposite edge portions of the plates 11 attached to the chain 28 bear directly on backing strips 29 of hard, low-loss, nonpolar, low-friction, dielectric material, such as polyethylene plastic, bonded to the upper flanges of supporting I beams constituting the press bed 30. Such hard polyethylene plastic material is high density polyethylene, or even ultrahigh molecular weight polyethylene. The I beam flanges and strips 29 supporting opposite sides of plates 11 are spaced apart sufficiently to receive the chain 28 between them.

The upper endless tread belt 12 includes tread plate portions 31 made of quite hard dielectric material, such as poluyrethane, like the tread portions 26 of the lower endless tread belt. Each of these tread plate portions is bonded to a metal plate 32 that is secured by bolts to a tread plate 12 secured to the endless chain 33. Such chain is received in the slot between backing strips 34 bonded to the lower flanges of I beams 35. Such backing strips, like the strips 29, are made of hard low-friction dielectric material, such as polyethylene plastic. The chain 33 is driven by the driven chain 23.

The entire upper endless tread belt mechanism is supported by superstructure including the parallel I-beams 35 that are carried by, and project downward from, a frame 36. Such frame has a passage 37 in it, through which the upper return stretch of the endless tread belt 12 passes. This frame is guided for elevational movement by upright guide rods 38 reciprocable in an elevationally adjustable support 39.

With such support in any selected elevationally adjusted position corresponding to the depth of a pack P of boards, downward pressure can be exerted on the lower stretch of the upper endless tread belt for the purpose of compacting the boards in the pack P while the adhesive is being set. Downward force is created by supplying gas or liquid under pressure to an expandable chamber 40, such as an elongated flattened air bag. Such air bag is interposed between the support 39 and the frame 36. Force exerted by expansion of the air bag is transmitted through the I beams 35 and the backing strips 34 to the tread plates 31, 32.

Figure 7:
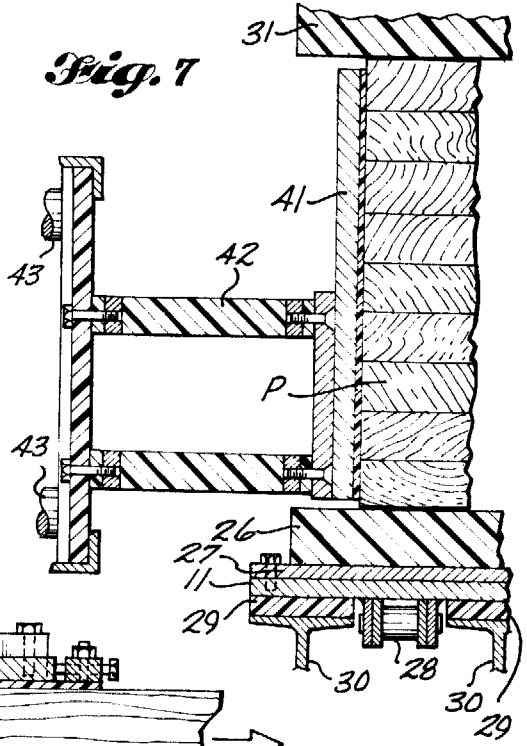
FIG. 7 is a detail vertical section through a portion of the press taken on line 7—7 of FIG. 6.
Figure 5:
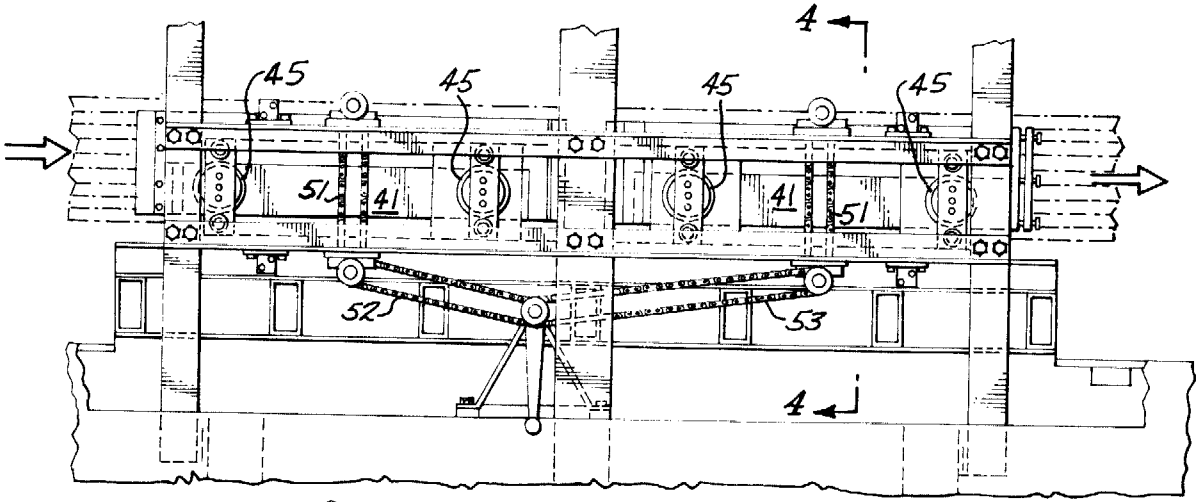
FIG. 5 is a side elevation of a portion of the press showing portions of the press mechanism different from those shown in FIG. 3.
Figure 6:
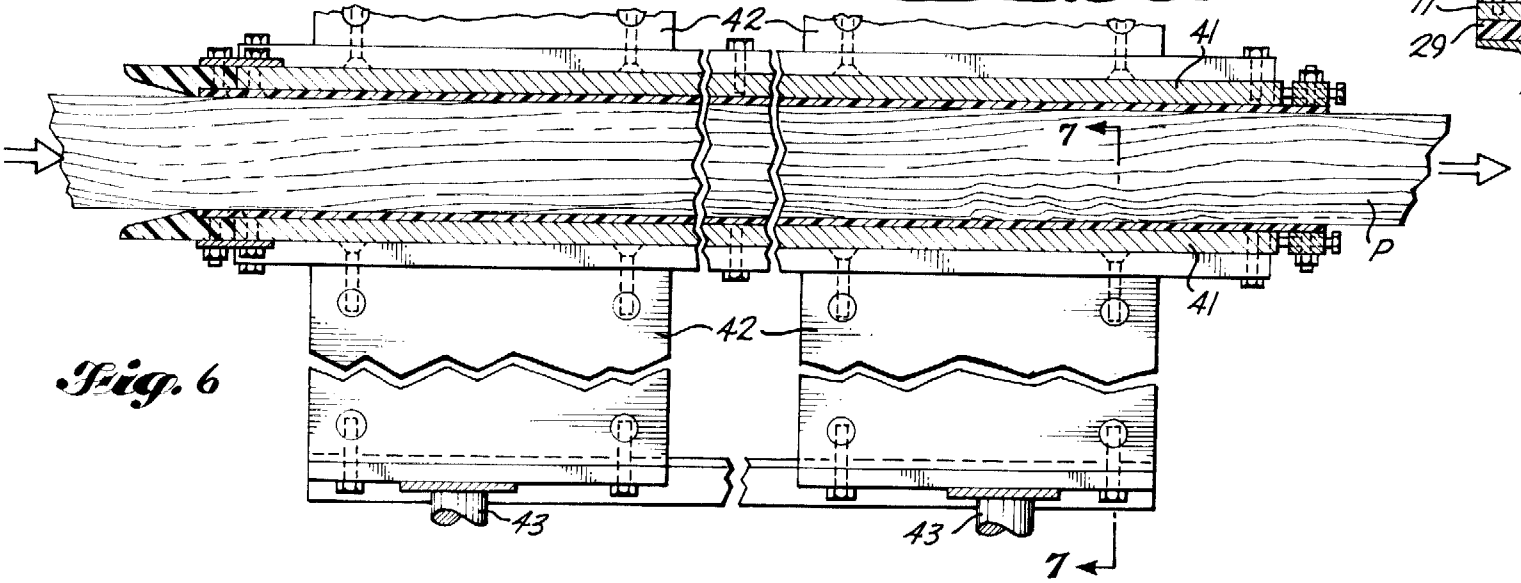
FIG. 6 is a horizontal plan through a portion of the press on an enlarged scale, parts being broken away.

While the boards of the pack P are thus held under pressure, the coordinated movement of the lower belt 11 and of the upper belt 12 moves the pack P longitudinally between dielectric heating electrodes 41 shown best in FIGS. 4 and 7 which are elongated lengthwise of the pack and, as shown in FIG. 5 5, extend over virtually the entire length of the endless tread belts. Such electrodes are carried by mounts 42 mounted on slides 43 reciprocable in guides 44. These electrodes may be pressed resiliently toward the opposite sides of the pack P. respectively, by inflatable bags 45 interposed between the mounts 42 and supports 46 which, in turn, are carried by slides 47 reciprocable in guides 48.

The guides 48 are mounted stationarily on posts 49 of the press frame. Also mounted on such posts are screws 50 engageable with the electrode supports 46 for effecting movement of such supports toward or away from a pack P of boards in the main press section 3 of the press. All of the screws 50 at one side of the endless tread belts are interconnected by chains 51, 52 and 53. Sprockets engaged by chains 52 and 53 at opposite sides of the press are secured to a cross shaft 54 on one end of which a crank 55 is mounted.

Because all of the screws 50 at each side of the press are connected by the chains 51, 52 and 53 and because such chains 52 and 53 at opposite sides of the press are interconnected by shaft 54, manual turning of the crank 55 will rotate all of the screws 50 at the same speed to move the electrode supports 46 at opposite sides of the press to the same extent toward or away from the pack P of boards. By such crank turning, therefore, the positions of the electrode mounts at opposite sides of the endless tread belts can be adjusted toward or away from each other quickly and easily for approximate location of the electrodes 41 corresponding to the width of the boards in a particular pack. When the positions of the electrode mounts have been thus set, the bags 45 can be inflated to press the electrodes resiliently against opposite sides of the pack.

It is desirable to deter leakage of radio-frequency energy from the electrodes 41 past the edges of the electrically-insulating tread plates 26 to grounded metal electrically-conducting portions 11 or 27 of the tread plates or the chain 28 as far as possible. Consequently, the insulating tread plate portion 26 should be sufficiently wide and thick so that the leakage path from the electrodes 41 at opposite sides of the pack P of boards to an electrically-conducting portion of the endless tread belt is at least great enough to prevent appreciable leakage of radio-frequency energy from such electrodes. While it is preferred that both of the electrodes 41 be live, one of such electrodes could be live and the other grounded, as in a single ender system.

If it should be desired to relieve the pack of boards P from pressure by the upper endless tread conveyor 12, the entire frame 36 and the conveyor driving mechanism can be raised relative to the support 39 by deflating the bag 40 and inflating bags 56, shown in FIG. 3. Such bags are engaged between upper cross pieces of the frame 36 and the upper portion of the support 39. Inflation of such bags moves the slides 38 upward to raise the endless tread conveyor 12 bodily through a short distance.

If it should be desired to retract the entire upper endless tread conveyor upward a substantial distance, such retraction can be effected by rotating simultaneously internally threaded sleeves 57 threadedly engaged with screws 58, the lower ends of which are connected to and carry the entire endless tread belt support 39. Preferably, at least four sets of internally threaded sleeves 57 and screws 58 carry the endless tread conveyor support 39. Such pairs of sleeves and screws are arranged in the rectangular relationship shown at the left of FIG. 1.

In order to insure simultaneous and equal elevational movement of all of the screws 58, the pairs of threaded sleeves 57 spaced transversely of the press are connected by chains 59. Also, two of the threaded sleeves spaced lengthwise of the press are connected by a chain 60. All of the threaded sleeves 57 are thus interconnected for conjoint rotation to raise and lower the upper endless tread belt evenly.

The entire hold-down 10 can also be raised and lowered, as may be desired, by simultaneous rotation of internally-threaded sleeves 61 with which screws 62 are threadedly engaged. Such screws, preferably four in number, arranged in rectangular relationship, support the hold-down. The screws of each pair spaced transversely of the press are connected by transverse chain loops 63, and two of the threaded sleeves 61 spaced longitudinally of the press are connected by a chain loop 64, so that all of the threaded sleeves 61 are turned conjointly.

If either the hold-down 10 or the upper endless tread belt 12 is to be raised or lowered, it is desirable for the other to be raised or lowered simultaneously and to the same extent. Consequently, it is desirable to connect one of the hold-down threaded sleeves 61 with one of the upper endless tread belt threaded sleeves 57 by a chain loop 65, as shown in FIGS. 1 and 3, in particular, to coordinate rotation of all of the threaded sleeves 57 and all of the threaded sleeves 61. The chain and threaded sleeve system can be driven manually or by an electric or hydraulic motor, as may be desired.

Figure 8:
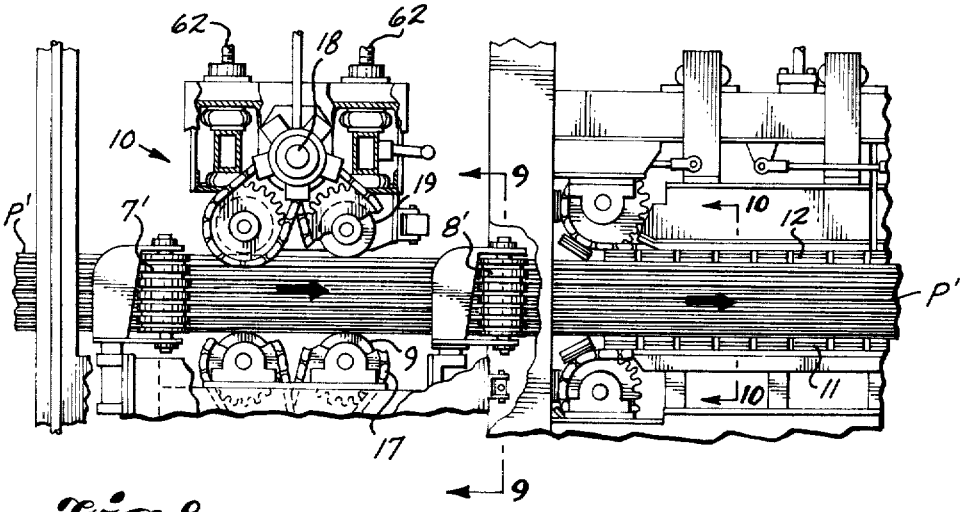
FIG. 8 is fragmentary side elevation of the feed end portion of a travelling press constructed to secure boards in a pack in predetermined relatively offset relationship edgewise.
Figure 10:
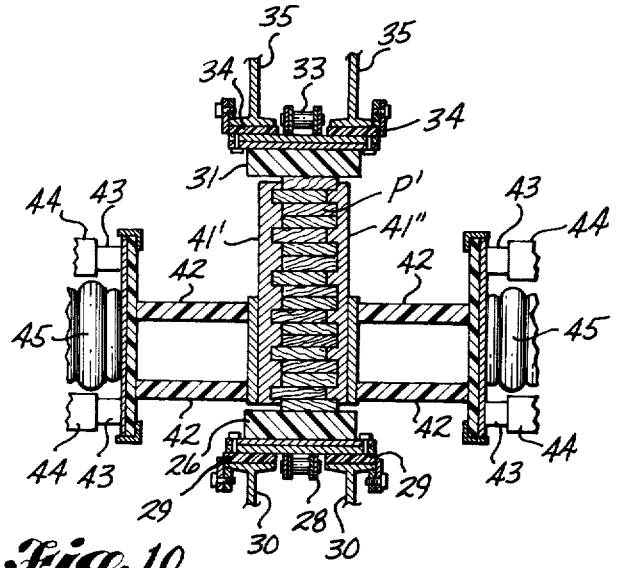
FIG. 10 is a vertical section taken on line 10—10 of FIG. 8.
Figure 9:
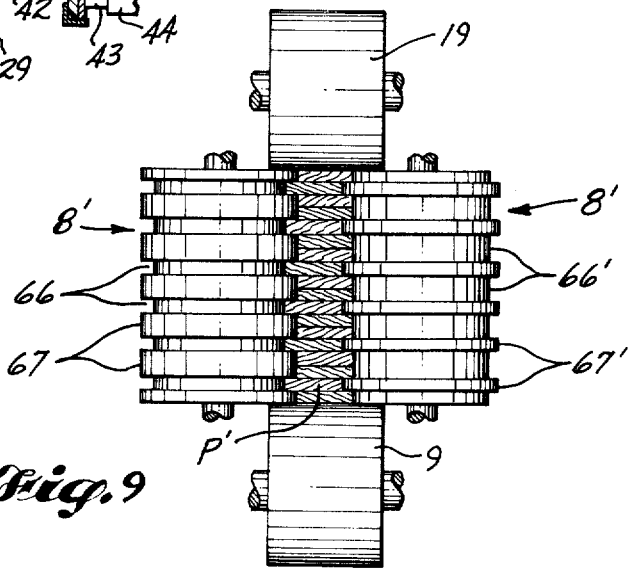
FIG. 9 is a vertical section through such press mechanism taken on line 9—9 of FIG. 8.

In FIGS. 8, 9 and 10, a modification of the press mechanism is shown for securing boards in a stack in predetermined relationship relatively offset edgewise. In use of the press described above, the entire stack of boards can be bonded together such as to make a laminated beam, or any desired number of boards can be secured together to make laminated products. The press of FIGS. 8, 9 and 10 is particularly adapted to bond boards of a stack in groups of three to provide tongue-and-groove members, although such members can be designed to accommodate groups of more than three boards. For this purpose, adhesive can be applied to opposite sides of the central board of each group of three. In the stack P', during the bonding operation, such central boards are then displaced edgewise relative to the boards on opposite sides of them, so that one edge of each central board will project beyond the corresponding edges of the boards on opposite sides of it to form a tongue, and a groove will be formed between the opposite edges of the two side boards.

In FIGS. 8 and 9, the edge rollers 8' mounted on pivoted mounts are shown as having profiled peripheries conforming to the respective sides of the board stack when the central board of each group of three is displaced edgewise relative to the boards on opposite sides of it. Thus, as seen in FIG. 9, the left roller 8' has annular grooves 66, each of a width to receive an edge portion of a central board of a group of three, which grooves are spaced by annular lands 67 of an axial extent equal to twice the thickness of a board in the stack, less a compressive allowance.

The opposite edge roller 8' at the right of FIG. 9 has annular grooves 66' of an axial extent equal to the thickness of two boards, which are spaced apart by lands 67' of an axial width equal to the thickness of the central board of each group of three less a similar compression allowance. The grooves 66' in the right roller 8' are in registration transversely of the stack of boards P' with the lands 67 of the left side roller. Correspondingly, the lands 67' of the right roller 8' are in registration transversely of the stack of boards P' with the grooves 66 of the left roller 8'.

The depth of the grooves 66 in the left roller 8' is equal to the height of the lands 67' of the right roller, and the depth of the grooves 66' of that roller. Consequently, if all of the boards of the stack P' are of the same width, the two rollers 8' will insure that the central board of each group of three boards is offset to the left, as seen in FIG. 9, the same distance relative to the boards on opposite sides of such central boards, to provide members having central tongueson tongues on side projecting a distance equal to the depth of the complemental groove on the opposite side of such tongue-and-groove member.

As seen in FIG. 8, both the infeed rollers 7' and the outfeed rollers 8' of the prepress unit will be profiled for the production of tongue-and-groove members. In the endless tread portion of the press at the discharge side of the prepress component, shown at the right of FIG. 8, the electrodes 41' and 41'' will have grooved surfaces corresponding to the profiles of the prepress rollers 7' and 8'.

Thus, the left electrode plate 41', shown in FIG. 10, has grooves of a width equal to the thickness of a single board, which are spaced apart by ribs having widths equal to twice the thickness of a board. Complementally, the right electrode plate 41'' has grooves of a width equal to twice the thickness of a board of the stack P' spaced by ribs of a width equal to the thickness of a single board. As shown in FIG. 10, the grooves in electrode plate 41' are in registration with the ribs of the electrode plate 41'' and the ribs of the electrode plate 41' are in registration with the grooves of the electrode plate 41''. Such electrode plates will therefore embrace the opposite edges, respectively, of a stack of boards having the central board of each set of three offset relative to the boards on opposite sides of it, as established by the rollers 7' and 8' of the prepress unit.

As the stack of boards P' is moved through the press unit shown in FIGS. 8 and 10 by pressure of the opposite endless tread belts 11 and 12 on opposite sides of the stack, each group of boards will be bonded by dielectric heating effected by the electrodes 41' and 41'', so that a stack of tongue-and-groove fabricated members will be discharged from the press. It will be evident that the prepress side rollers and the electrode plates can be contoured in any pattern desired to guide through the press a stack of boards having corresponding side contours.

In some instances, it may be desirable for laminated beams to be produced by the press of the present invention which are bent lengthwise. To produce such beams, the individual boards of the stack P'' are bent individually lengthwise and adhesive between such boards is set while they are held in such bent relationship. Such a bend will be on a very large radius, such as for the purpose of producing laminated beams with camber for arched roofs, for example. Press mechanism for producing such curved laminated packs of boards is shown in FIGS. 11 and 12.

In order to bond the boards of the pack P'' together so that the bonded structure which emerges from the press will be curved lengthwise, it is necessary for the endless tread belts 11 and 12 on opposite sides of the board pack to be curved complementally correspondingly. Thus, one of the endless tread belts, shown in FIG. 11 as the belt 11, will have a concave curvature toward the board pack, and the other endless tread belt 12 will have a complemental convex curvature toward the board pack.

Figure 11:
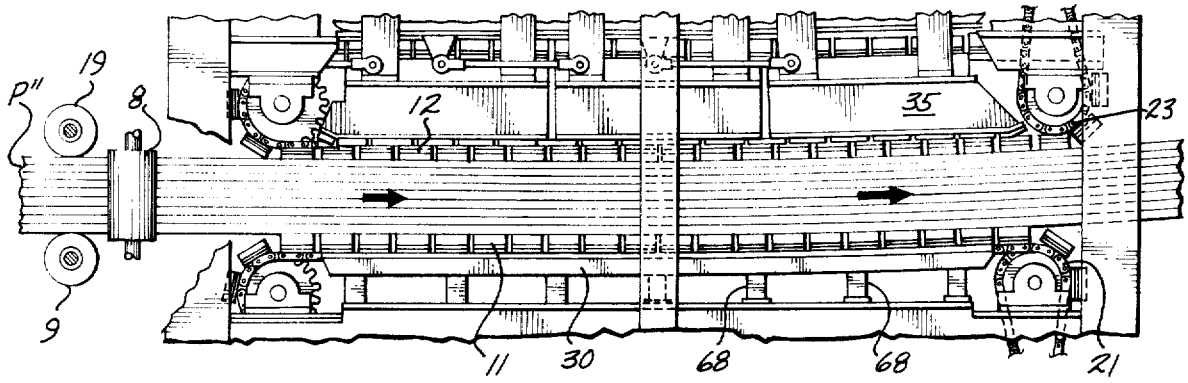
FIG. 11 is a fragmentary longitudinal section through press mechanism arranged to secure the boards of a pack together in longitudinally curved condition.
Figure 12:
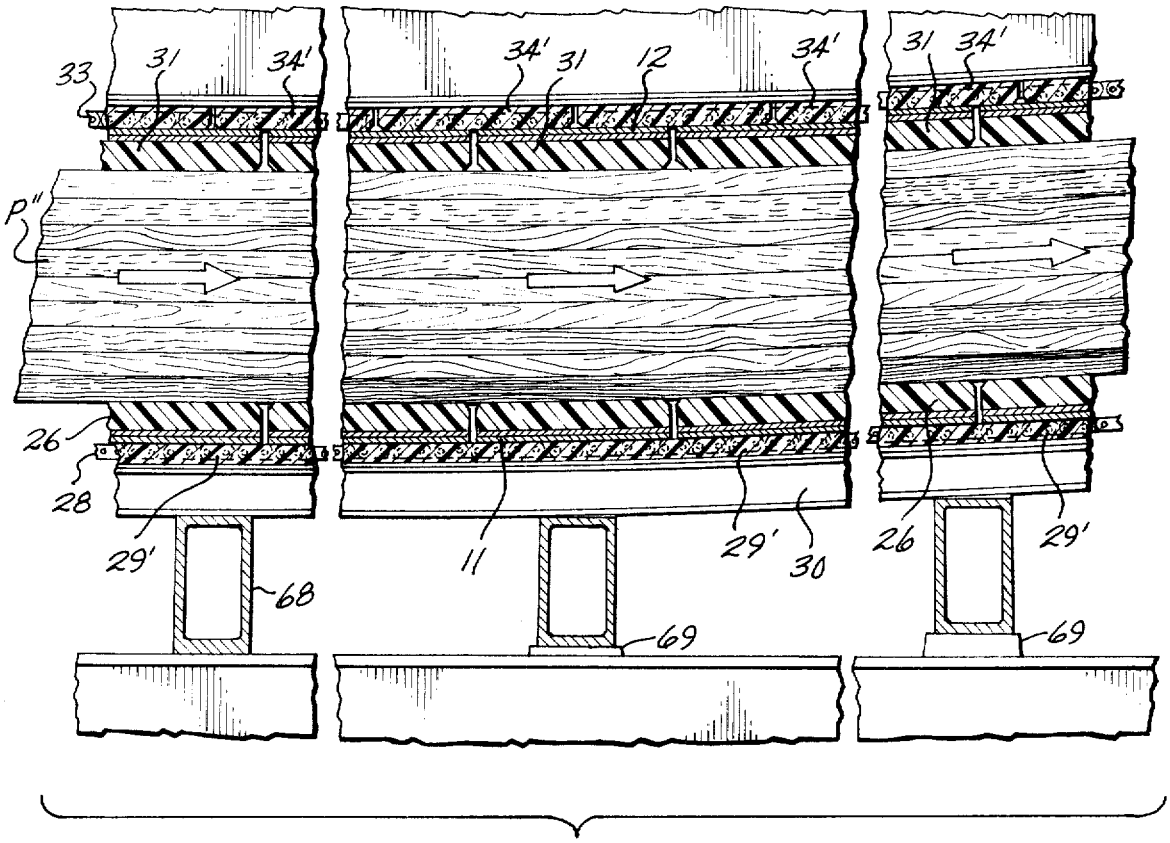
FIG. 12 is a fragmentary enlarged longitudinal section through such a press.

The endless tread belts may be shaped to the desired longitudinally curved contour by providing supporting members 29' for the belt 11 and forming the members of the press bed 30 increasing in elevation from left to right, as seen in FIGS. 11 and 12. Correspondingly, the backing members 34' for the opposite endless tread belt 12 will increase in elevation from left to right, as seen in FIGS. 11 and 12. Such increase in elevation of the backing members 29' for endless tread belt 11 and of the backing members 34' for endless tread belt 12 is effected by deforming the frame of the press slightly by placing under supports 68 at the discharge end of the press shims 69 of different thicknesses or other elevating means. Each shim or elevating means farther from the discharge end of the press is thinner than the next shim or elevating means closer to the discharge end of the press.

Because of such variation in elevation of the backing members, the laminated member, P'', emerging from the press will curve upward if the individual laminations moving into the press are in horizontal planes, and will curve to one side if the laminations moving into the press are in vertical planes. The curvature of the endless tread belt stretches engaging the opposite sides of the stack of boards will be very gradual. The difference in thickness of the adjacent shims or elevating means will determine the degree of curvature of the opposite stretches of the endless tread belts.

The prepress section of the press shown in FIGS. 11 and 12 is the same as the prepress section 2 shown in FIGS. 1 and 2. Consequently, the prepress compacting rollers 9 and 19 and the outfeed edge rollers 8 are shown rather diagrammatically. The pack of boards P can be fed into the prepress unit in the same manner as described with reference to the press of FIGS. 1, 2 and 3. In such case, each board will be in a horizontal plane. Alternatively, the press structure can be rearranged so that each board of the pack will be disposed in a substantially vertical plane as it moves through the prepress and the bonding sections.

I claim:

1. A laminating travelling press for laminating a pack of boards, comprising presser means including two endless tread belt stretches having substantially continuous planar parallel opposing faces for receiving a pack of boards therebetween and engaging the opposite sides of such board pack, respectively, each stretch being composed of a series of tread members in closely spaced relationship, each tread member including a metal plate having leading and trailing edges hingedly connected, respectively, to the adjacent edges of two adjacent metal plates, and each metal plate having a press block of hard plastic insulating material bonded thereto and forming a face engageable with a pack of boards, two backing means, one for each of said endless tread belt stretches and each having a stationary bearing pressure surface of hard, low-friction dielectric material against which said metal plate of said two endless tread belt stretches slidably bear and yieldable pressure means urging said backing means relatively toward each other, dielectric heating electrodes at opposite sides of and adjacent to the pack of boards, said electrodes being elongated lengthwise of said endless tread belt stretches, extending along the major portion of the length of said endless tread belt stretches, located between the planes of said parallel endless tread belt opposing faces and of a width substantially equal to the width of the pack of boards, the electrical leakage path between each electrode and said metal plates of said endless tread belt stretches being of a length at least sufficient to deter substantial leakage of radio-frequency energy from an electrode to said metal plates, and means for moving said endless tread belt stretches lengthwise synchronously relative to said pressure means for moving the pack of boards lengthwise while sliding said metal plates in pack-compacting pressing engagement with said hard, low-friction dielectric material stationary bearing pressure surface of said backing means.

2. The press defined in claim 1, in which the press blocks are of polyurethane material.

3. The press defined in claim 1, the stationary bearing pressure surface against which the tread plates slidably bear being of hard polyethylene plastic material.

4. The press defined in claim 1, and means supporting the dielectric heating electrodes and guiding such electrodes for movement toward and away from a pack of boards, and resilient pressure means pressing the dielectric heating electrodes toward the pack of boards.

5. The press defined in claim 4, in which the resilient pressure means are pneumatic means.

6. The press defined in claim 4, and adjustable means carrying the resilient pressure means and movable for shifting the resilient pressure means toward and away from the pack of boards.

* * * * *